US006131569A

United States Patent [19]

Schuster

[11] Patent Number: 6,131,569

[45] Date of Patent: Oct. 17, 2000

[54] OXYGEN INHALER

[76] Inventor: Christoph Schuster, Feuerbacher Heide 61, 70192 Stuttgart, Germany

[21] Appl. No.: 09/125,628

[22] PCT Filed: Feb. 24, 1997

[86] PCT No.: PCT/DE97/00324

§ 371 Date: May 7, 1999

§ 102(e) Date: May 7, 1999

[87] PCT Pub. No.: WO97/30745

PCT Pub. Date: Aug. 28, 1997

[30] Foreign Application Priority Data

Feb. 23, 1996 [DE] Germany ..... 196 06 944

[51] Int. Cl.[7] ..... A61M 15/00

[52] U.S. Cl. ..... 128/200.24; 128/202.12; 128/204.23; 128/205.25; 128/205.26; 600/520

[58] Field of Search ..... 128/200.24, 202.26, 128/205.12, 204.23, 205.17, 202.25, 205.25, 205.26, 204.29, 202.12; 600/520, 532, 21; 606/20; 482/13

[56] References Cited

U.S. PATENT DOCUMENTS

| | | | |
|---|---|---|---|
| 3,493,703 | 2/1970 | Finan . | |
| 4,265,238 | 5/1981 | Swiatosz et al. | 128/205.12 |
| 4,471,774 | 9/1984 | Swiatosz | 128/205.12 |
| 4,622,980 | 11/1986 | Kunig et al. | 600/520 |
| 4,648,395 | 3/1987 | Sato et al. | 128/204.23 |
| 4,664,108 | 5/1987 | Ansite | 128/202.26 |
| 4,681,099 | 7/1987 | Sato et al. . | |
| 4,919,132 | 4/1990 | Miser | 128/205.17 |
| 4,941,068 | 7/1990 | Hofmann | 128/202.25 |
| 4,986,268 | 1/1991 | Tehrani . | |
| 5,048,824 | 9/1991 | Chen . | |
| 5,749,359 | 5/1998 | Hanson | 128/205.25 |
| 5,799,652 | 9/1998 | Kotliar | 128/205.11 |

FOREIGN PATENT DOCUMENTS

| | | |
|---|---|---|
| 0 28 209 | 5/1981 | European Pat. Off. . |
| 02 66 051 | 5/1988 | European Pat. Off. . |
| 05 02 270 | 9/1992 | European Pat. Off. . |

*Primary Examiner*—John G. Weiss
*Assistant Examiner*—V. Srivastava

[57] ABSTRACT

The invention concerns a method of preparing the respiratory air for an oxygen-air mixture wherein extremely pure oxygen gas is added to the air being inhaled. The volumetric amount of oxygen added to the oxygen-air mixture to be prepared depends on the given physical performance to be measured.

23 Claims, 1 Drawing Sheet

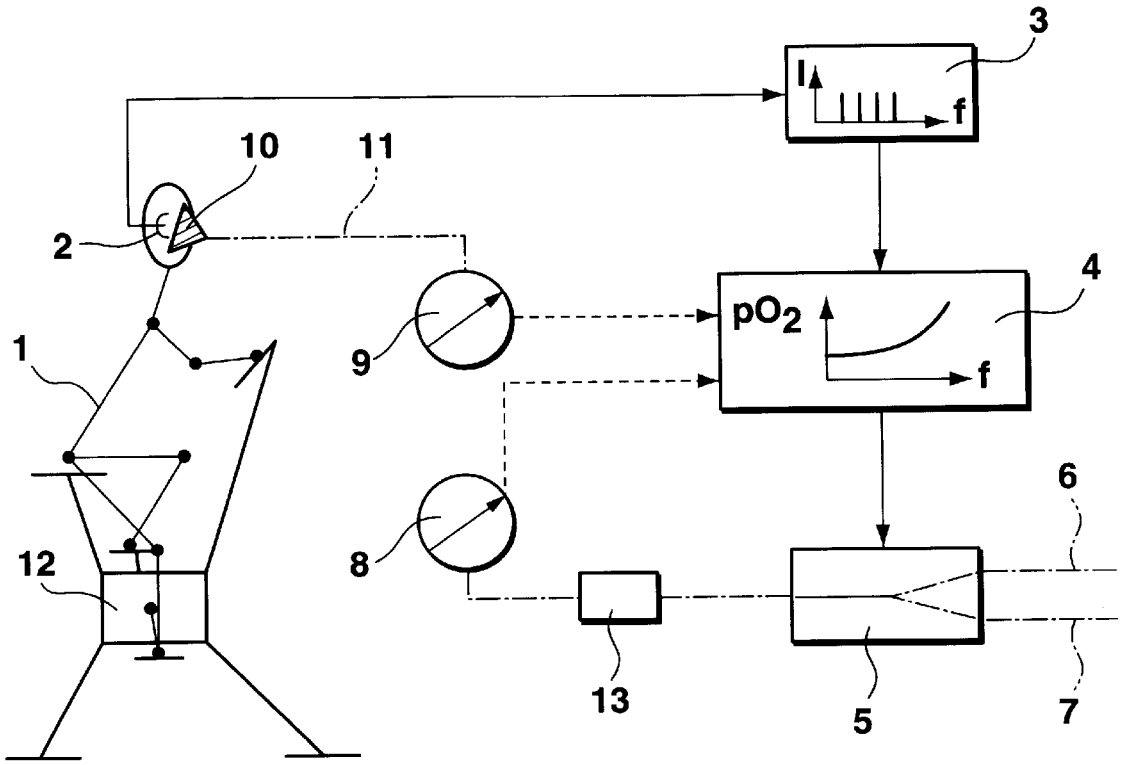
3
I
f
10
11
2
4
pO2
f
1
9
6
8
12
13
5
7

OXYGEN INHALER

BACKGROUND OF THE INVENTION

The invention concerns a method for preparation of respiratory air of an oxygen air mixture with the addition of substantially pure oxygen gas into air to be inhaled by organisms, in particular human beings, and having a device for physical exercise during inhalation. This type of respiratory air preparation using substantially pure or purely ionized oxygen is primarily used, with great success, for elderly people having low nominal arterial oxygen partial pressure ($pO_2$) to permanently increase this nominal $pO_2$ (the principle of Ardennen-$O_2$, multi-step therapy).

In the conventional method, an oxygen-air mixture is administered to the individual to be supplied with the oxygen-air mixture using a device providing oxygen. The oxygen volume fraction of the oxygen-air mixture to be prepared is set, as a constant time-independent value, at the device providing the oxygen. In particular, oxygen pressure vessels, central oxygen supply installations, devices for the extraction of oxygen through the decomposition of oxygen-rich chemicals, oxygen separation systems having membranes or the like are thereby utilized as the oxygen delivering device. The air mixture having increased oxygen content is applied using breathing masks, nose probes, open applicators or the like.

These conventional methods for preparing respiratory air of an oxygen-air mixture have the following disadvantages. Since the oxygen volume fraction of the oxygen-air mixture to be prepared is set as a fixed quantity at the device delivering the oxygen, the constant oxygen intake is independent of changeable quantities influencing the individual being supplied with the oxygen-air mixture. These quantities are e.g. a changing physical power output of the person being supplied with oxygen. In addition, difficult and time consuming investigations must be initiated to determine the percentage of oxygen volume fraction in the oxygen-air mixture to be prepared in dependence on the physiologically constant quantities of the person being supplied with the oxygen-air mixture, e.g. age, gender, size, weight, physical condition and the like. Adjustment to the instantaneous power being expended by the person supplied with the oxygen-air mixture and of the oxygen fraction of the oxygen-air mixture does not occur or, if at all, in a very poor fashion through manual adjustment.

SUMMARY OF THE INVENTION

The method in accordance with the invention, wherein the enrichment is controlled in dependence on the current physical personal data measured (age, power output) of the person being supplied has, in contrast thereto, the advantage that the oxygen volume fraction of the prepared oxygen-air mixture to be administered is controlled in dependence on the instantaneous measured physical power output of the organism to be supplied with the oxygen-air mixture in such a fashion that when the physical power increases, the oxygen volume fraction of the oxygen-air mixture increases and when the physical power decreases the oxygen volume fraction of the oxygen-air mixture decreases. The oxygen volume fraction can thereby be adjusted to the physical power increase of the person being supplied as a result of which, a larger amount of oxygen can be taken up to thereby increase the arterial $pO_2$. Towards this end, the oxygen volume fraction can lie between 20% and 75% of the total input oxygen-air mixture, wherein the organism being supplied with the oxygen-air mixture expends the physical power to be measured in cooperation with a home exerciser or the like with adjustment to the individual power level (a bicycle ergometer, a rowing machine, a rotating jogging belt or the like). An important advantage is that the oxygen intake of the blood depends on the actual power output of the organism. It has turned out that a long term increase in the partial oxygen pressure in the blood can only be achieved by means of oxygen intake during power output and is substantially dependent thereon.

In accordance with an advantageous configuration of the invention, the measurable pulse frequency of the organism being supplied with the oxygen-air mixture serves as a measure of the physical power output.

In accordance with an additional advantageous configuration of the invention, the measurable blood pressure of the organism to be supplied with the oxygen-air mixture serves as a measure of the delivered physical output.

In accordance with an additional advantageous configuration of the invention, the pulse frequency, together with the blood pressure of the organism to be supplied with the oxygen-air mixture serves as a measure for the physical power output.

In accordance with an additional advantageous configuration of the invention, a power measure unit (e.g. a watt meter or a tachometer in the event of a home exerciser) serves as a measure of the physical power output of the organism to be supplied with the oxygen-air mixture.

In accordance with an additional advantageous configuration of the invention, a monitoring and regulating unit controls the oxygen volume fraction of the oxygen-air mixture such that same is dependent upon physiologically given quantities (type, age, gender, size, weight, physical condition and the like) as well as on the instantaneously measured time varying power output of the organism to be supplied with the oxygen-air mixture in order to determine and to prepare the regulated oxygen volume fraction as well as the overall oxygen-air flow of the oxygen-air mixture.

In accordance with an additional advantageous configuration of the invention, control of the prepared oxygen-air fraction of the oxygen-air mixture is effected through change of the oxygen pressure or the cross-sectional relationship ratios of air to oxygen intake.

In accordance with an additional advantageous configuration of the invention, the oxygen gas is prepared chemically, in particular through the decomposition of oxygen-rich chemicals using mechanical means, in particular through the extraction of the oxygen by means of membranes (L-pumps and motor) or through physical techniques, in particular through the preparation of oxygen using gas pressure bottles or gas pressure conduits.

Further advantages and advantageous configurations of the invention can be extracted from the subsequent description, the drawing and the claims.

BRIEF DESCRIPTION OF THE DRAWING

An embodiment of the method in accordance with the invention is shown in the drawing and described more closely below.

FIG. 1 shows a method for breathing air preparation

FIG. 1 illustrates a method for respiratory air preparation for an air-oxygen mixture with the addition of largely pure oxygen gas to the air to be inhaled by an organism, in particular a human being. The person 1 to be supplied with the oxygen-air mixture is subjected to physical exercise by means of a home exerciser 12, for example a bicycle ergometer. Towards this end, a pulse detector 2 measures the pulse of the person and introduces same to a pulse frequency detector 3. The measured pulse frequency constitutes a time varying input to the monitoring and regulation unit 4. In addition, the monitoring and regulation unit 4 has given physiological quantities which are constant over time such as age, gender, size, weight, physical condition and the like of the person to be supplied with oxygen. Appropriate programming of the monitoring and regulation unit 4 controls the mixing unit 5. In the mixing unit 5, the oxygen volume flow 6 and the air volume flow 7 are mixed in such a fashion that, in dependence on the continuously varying as well as the time-constant quantities introduced to the monitoring and regulation unit 4, an individually differing optimized oxygen-air mixing ratio for respiratory air preparation is effected for the person to be provided with the oxygen air mixture. The prepared oxygen-air mixture is introduced to the person 1 by means of an oxygen-air mixture conduit 11 and an oxygen applicator 10. Various differing measuring apparatus are introduced into the oxygen-air mixture conduit 11, in particular, a flow meter 8 measuring the overall volume flow as well as a fractional oxygen meter 9 to measure the oxygen fraction of the applied air. The measure data are thereby introduced to the monitoring and regulation unit 4 to thereby, if appropriate, effect regulation in the event that the actual values deviate from the desired values. When the person stops exercising, the oxygen supply can be cut-off.

DESCRIPTION OF THE PREFERRED EMBODIMENT

All of the features represented in the description, the claims and the drawing can be pertinent to the invention individually and collectively in arbitrary combination.

REFERENCE SYMBOLS

1 an exercising person who is to be supplied with the oxygen-air mixture
2 pulse detector
3 pulse frequency detector
4 monitoring and regulation unit
5 mixing unit
6 oxygen volume flow
8 flow meter
9 oxygen fraction sensor
10 oxygen applicator
11 oxygen-air mixture conduit
12 home exerciser
13 ionizer

What is claimed is:

1. A method for preparation of respiratory air having an enrichment of an oxygen fraction for a person inhaling the air while carrying out physical exercise on a device therefor, the method comprising the steps of:

a) measuring a power output of the exercising person;

b) enriching a degree of oxygen in direct proportion to said power output of the person, wherein the oxygen fraction of the respiratory air increases with increasing power output and decreases with decreasing power output; and c) interrupting an oxygen supply when said power output of the exercising person is interrupted.

2. The method of claim 1, further comprising the step of additionally ionizing respiratory air.

3. The method of claim 1, further comprising the step of creating the enrichment of the oxygen fraction by adding, to an ambient air intake, at least one of substantially pure oxygen gas and ionized oxygen gas.

4. The method of claim 1, further comprising the step of enriching an oxygen fraction of ambient air in an enrichment device.

5. The method of claim 1, wherein the oxygen fraction of the respiratory air being inhaled assumes a value between 20% and 75% per volume.

6. The method of claim 1, wherein step a) comprises the step of measuring a degree of physical exercise by detecting a pulse frequency of the exercising person.

7. The method of claim 1, wherein step a) comprises the step of measuring a blood pressure of the exercising person.

8. The method of claim 1, wherein step a) comprises the step of measuring exercise of limbs of the person.

9. The method of claim 8, wherein one of a bicycle ergometer and a belt velocity of a rotating jogging belt is measured.

10. The method of claim 1, wherein step a) comprises the step of measuring a physiologically given quantity of the person.

11. The method of claim 10, wherein at least one of an age, a gender, a size, a weight and a type of the person is measured.

12. The method of claim 1, wherein step b) comprises the step of changing at least one of an oxygen pressure and an oxygen intake cross section.

13. The method of claim 1, wherein step b) comprises the steps of introducing ambient air via a pump and changing a power output of said pump in proportional to a power output of the exercising person.

14. An apparatus for preparation of respiratory air having an enrichment of an oxygen fraction for a person inhaling the air while carrying out physical exercise on a device therefor, the apparatus comprising:

means for measuring a power output of the exercising person;

means for enriching a degree of oxygen in direct proportion to said power output of the person, wherein the oxygen fraction of the respiratory air increases with increasing power output and decreases with decreasing power output; and means for interrupting an oxygen supply when said power output of the exercising person is interrupted.

15. The apparatus of claim 14, wherein said exercise device is a home exerciser.

16. The apparatus of claim 15, wherein said home exerciser is one of a bicycle ergometer, a rowing apparatus and a rotating jogging belt.

17. The apparatus of claim 14, further comprising an ionizing apparatus for air disposed within a breathing air stream.

18. The apparatus of claim 17, wherein said ionization apparatus is disposed at an output of one of an oxygen intake and a respiratory air intake.

19. The apparatus of claim 14, wherein said measuring means comprise a pulse detector for measured a personal power output.

20. The apparatus of claim 14, wherein said means for effecting oxygen enrichment comprise a semi-permeable membrane.

21. The apparatus of claim 14, wherein said means for effecting oxygen enrichment comprise a device having a chemical agent to decompose air for oxygen production.

22. A Method for preparation of respiratory air having an enrichment of an oxygen fraction for a person inhaling the air while carrying out physical exercise on a device therefor, the method comprising the steps of:

a) measuring a physiologically given quantity of the person;

b) measuring a power output of the exercising person;

c) enriching a degree of oxygen in direct proportion to said power output of the person and in dependence on said physiologically given quantity, wherein the oxygen fraction of the respiratory air increases with increasing power output and decreases with decreasing power output; and d) interrupting an oxygen supply when said power output of the exercising person is interrupted.

23. An apparatus for preparation of respiratory air having an enrichment of an oxygen fraction for a person inhaling the air while carrying out physical exercise on a device therefor, the apparatus comprising:

means for measuring a physiologically given quantity of the person;

means for measuring a power output of the exercising person;

means for enriching a degree of oxygen in direct proportion to said power output of the person and in dependence on said physiologically given quantity, wherein the oxygen fraction of the respiratory air increases with increasing power output and decreases with decreasing power output; and means for interrupting an oxygen supply when said power output of the exercising person is interrupted.

* * * * *